US012584714B2

(12) United States Patent
Lee et al.

(10) Patent No.: US 12,584,714 B2
(45) Date of Patent: Mar. 24, 2026

(54) BALLISTIC RESISTANT PANEL EDGE ENHANCED INTEGRITY

(71) Applicant: Central Lake Armor Express, Inc., Arlington, VA (US)

(72) Inventors: Robert Lee, Jermyn, PA (US); Travis Paul Holt, Rapid City, MI (US); James Alan O'Neal, Bellaire, MI (US)

(73) Assignee: Central Lake Armor Express, Eden, NC (US)

( * ) Notice: Subject to any disclaimer, the term of this patent is extended or adjusted under 35 U.S.C. 154(b) by 165 days.

(21) Appl. No.: 18/378,748

(22) Filed: Oct. 11, 2023

(65) Prior Publication Data

US 2025/0035409 A1 Jan. 30, 2025

Related U.S. Application Data

(60) Provisional application No. 63/529,051, filed on Jul. 26, 2023.

(51) Int. Cl.
*F41H 5/04* (2006.01)

(52) U.S. Cl.
CPC ..... *F41H 5/04* (2013.01)

(58) Field of Classification Search
CPC ..... F41H 5/0471; B32B 5/073; B32B 5/024; B32B 5/12; B32B 38/08; B32B 2038/008; B32B 2260/023; B32B 2260/046; B32B 2262/0253; B32B 2262/0269; B32B 2377/00; B32B 2571/02; B32B 2607/00
USPC ..... 89/36.02
See application file for complete search history.

(56) References Cited

U.S. PATENT DOCUMENTS

| | | | | |
|---|---|---|---|---|
| 2,756,429 | A | 7/1956 | Malachowski | |
| 3,093,829 | A | 6/1963 | Maine | |
| 3,924,038 | A * | 12/1975 | McArdle | B32B 3/04 428/116 |
| 4,924,103 | A | 5/1990 | Stein et al. | |
| 5,557,802 | A | 9/1996 | Wickert | |
| 5,960,470 | A | 10/1999 | Bachner, Jr. | |
| 6,131,193 | A | 10/2000 | Bachner, Jr. | |
| 6,219,842 | B1 | 4/2001 | Bachner, Jr. | |
| 6,704,934 | B2 | 3/2004 | Graham et al. | |
| 7,251,835 | B2 | 8/2007 | Learmont | |

(Continued)

FOREIGN PATENT DOCUMENTS

| | | | | |
|---|---|---|---|---|
| CN | 116653387 | A | 8/2023 | |
| KR | 20180032405 | A | 3/2018 | |
| WO | WO-2024023678 | A1 * | 2/2024 | A41D 31/245 |

*Primary Examiner* — Samir Abdosh
(74) *Attorney, Agent, or Firm* — Inovue Advisors, LLC

(57) ABSTRACT

A ballistic resistant panel assembly, which includes a plurality of ballistic resistant plies positioned in a stack. Further including: a binding layer having a first portion which extends along and overlying a first ply, a second portion which extends from the first portion and along peripheral edges of a less than all of the plurality of ballistic resistant plies in the stack; and a third portion which extends from the second portion and along a second ballistic resistant ply, such that the second ballistic resistant ply is positioned between the first ballistic resistant ply and the third portion of the binding layer. The assembly further includes a plurality of stitches which extend through the first and third portions of the binding layer and through the first and second ballistic resistant plies of the stack.

42 Claims, 10 Drawing Sheets

(56) References Cited

U.S. PATENT DOCUMENTS

| | | | | |
|---|---|---|---|---|
| 8,596,182 | B2 | 12/2013 | Mann et al. | |
| 9,435,614 | B2 | 9/2016 | Beck | |
| 9,578,910 | B2 | 2/2017 | Strauß | |
| 9,851,181 | B2 | 12/2017 | Beck | |
| 10,267,601 | B1 | 4/2019 | Beck | |
| 10,317,175 | B2 | 6/2019 | Cejas | |
| 10,591,256 | B2 | 3/2020 | Beck | |
| 10,667,568 | B2 | 6/2020 | Rosati et al. | |
| 10,788,293 | B2 | 9/2020 | Beck | |
| 10,788,294 | B2 | 9/2020 | Goodson et al. | |
| 10,921,094 | B2 | 2/2021 | Beck | |
| 11,174,818 | B2 * | 11/2021 | Norman | F02K 9/97 |
| 11,448,485 | B2 | 9/2022 | Beck | |
| 11,650,025 | B2 | 5/2023 | Beck | |
| 11,713,945 | B2 | 8/2023 | Beck | |
| 11,965,718 | B2 | 4/2024 | Contri | |
| 11,994,368 | B2 * | 5/2024 | Beck | F41H 5/013 |
| 12,000,677 | B2 * | 6/2024 | Baggen | F41H 5/0485 |
| 2011/0061522 | A1 | 3/2011 | Jarrett | |
| 2012/0180177 | A1 | 7/2012 | Learmont | |
| 2013/0276623 | A1 | 10/2013 | Moore et al. | |
| 2015/0096479 | A1 * | 4/2015 | McCarthy | A47F 9/00 89/36.02 |
| 2017/0241748 | A1 * | 8/2017 | Cejas | B32B 5/022 |
| 2019/0390941 | A1 | 12/2019 | Beck | |
| 2021/0231409 | A1 | 7/2021 | Beck | |
| 2021/0310770 | A1 | 10/2021 | Beck | |
| 2022/0099047 | A1 * | 3/2022 | Norman | B64G 1/58 |
| 2023/0015396 | A1 | 1/2023 | Maurer et al. | |
| 2024/0167792 | A1 | 5/2024 | Beck | |

* cited by examiner

FIG. 9A
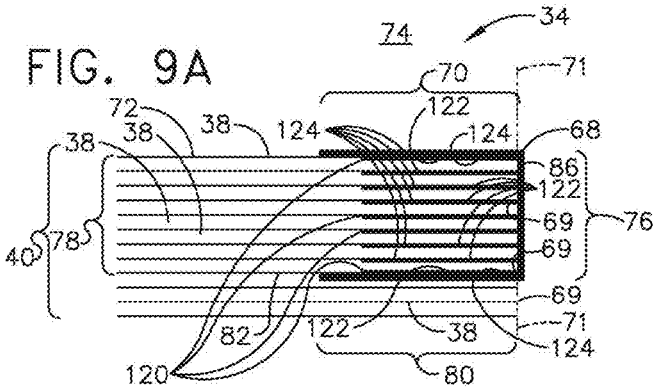
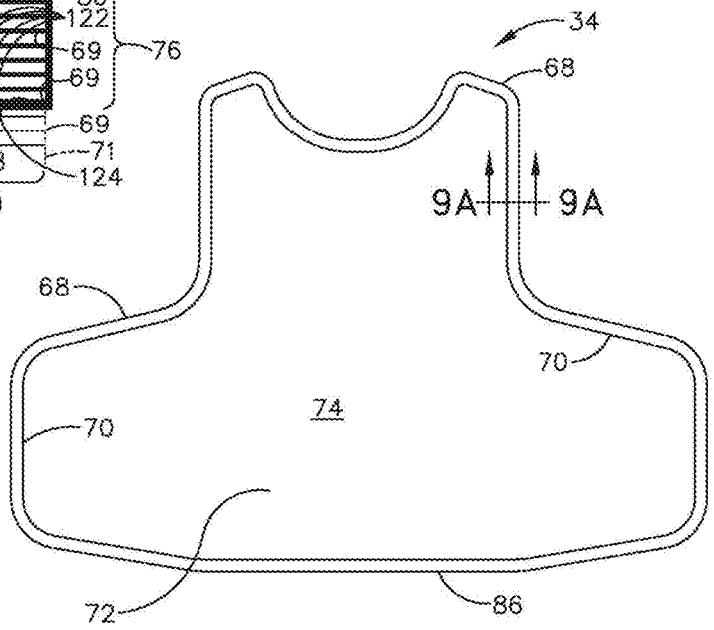
FIG. 9

FIG. 10A
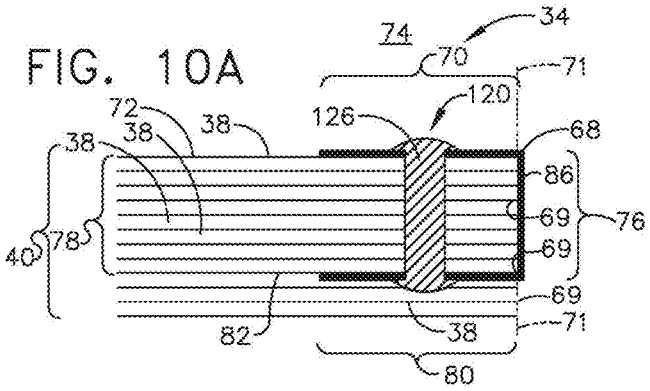
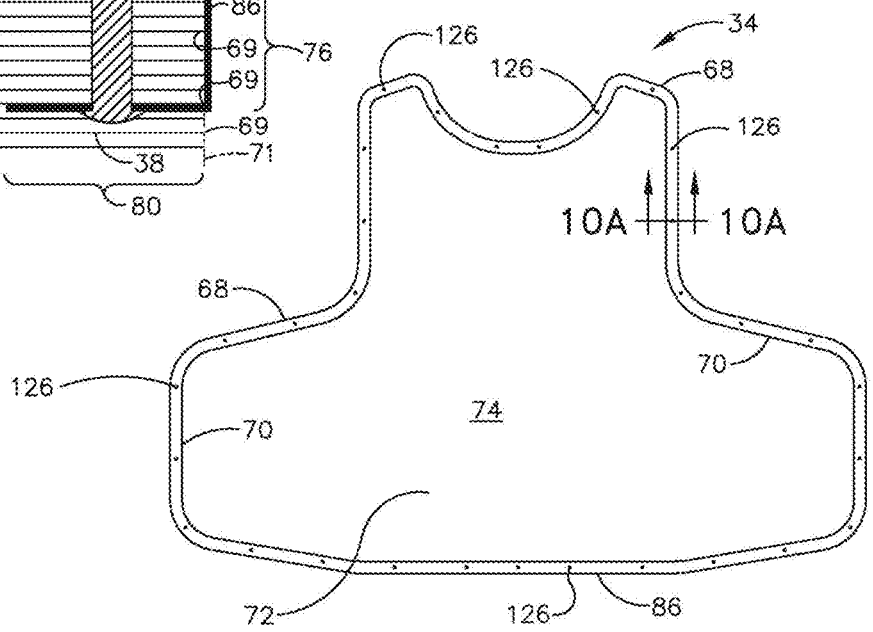
FIG. 10

BALLISTIC RESISTANT PANEL EDGE ENHANCED INTEGRITY

CROSS-REFERENCE TO RELATED APPLICATIONS

This application claims priority to U.S. Provisional Application No. 63/529,051, which was filed on Jul. 26, 2023 and is hereby incorporated by reference in its entirety.

FIELD

This disclosure relates to ballistic resistant panel assemblies, and more particularly ballistic resistant panel assemblies wherein the ballistic resistant panel assemblies include plies of ballistic resistant material.

BACKGROUND

Ballistic resistant panel assemblies have many applications of use for providing ballistic protection. One application of use for the ballistic resistant panel assembly is positioning them within a garment assembly to provide life-saving ballistic protection to a wearer. Ballistic resistant panel assemblies are strategically positioned within the ballistic resistant protective garment assembly to optimize protection to the wearer. Ballistic resistant protective garment assemblies that are worn under clothing of the wearer are referred to as concealable ballistic resistant protective garments and those worn outside of the clothing of the wearer are often referred to as a tactical ballistic resistant protective garment. Other applications of use for ballistic resistant panel assemblies include use with respect to handheld shields, backpacks, extremity protection devices, vehicles, personnel enclosures and other application of uses where protection from ballistic projectiles is needed.

Ballistic resistant panel assemblies can be constructed from a wide variety of ballistic resistant materials. A ballistic resistant panel assembly can, for example, have a plurality of plies. These plies can be constructed of ballistic resistant fibers configured in a woven fabric. The fibers can be selected from a wide variety of high strength ballistic resistant fibers having a composition such as an aramid, an ultra-high molecular weight polyethylene (UHMWPE) or other like high strength fibers utilized for ballistic protection. The plies are woven in a select weave pattern such as utilizing a plain weave, sateen weave or other common weave pattern employed for woven plies used for constructing a ballistic resistant panel assembly. Other ply constructions, for example, have a composite laminate unidirectional fiber construction which utilizes fibers composed of an aramid, (UHMWPE) fibers or other high strength fibers, which are positioned in layers within the ply such that each layer has unidirectional orientation of the high strength ballistic resistant fibers. The layers are laminated together with a material such as for example a polyethylene resin. Yet other examples of utilizing ballistic resistant material can include having a hard plate construction made from one or more of a metal, ceramic, and/or aramid materials which are positioned within the ballistic resistant protective garment. Construction of a ballistic resistant panel assembly include utilizing one or more of these various materials and constructions depending on the performance that is needed.

Ballistic resistant panel assemblies, such as used in a protective body armor garment assembly or in other applications of use of ballistic resistant panels, utilize a plurality of plies. The plies are constructed of a plurality of woven fibers or of composite unidirectional fiber laminates. Upon impact of a ballistic projectile onto a ballistic resistant panel assembly proximate to a peripheral edge portion of the ballistic resistant panel, such impact, whether in a direction generally perpendicular to the ballistic resistant panel assembly or in an angular direction relative to the ballistic resistant panel assembly, can promote separation of the plies within the ballistic resistant panel assembly, a phenomenon not likely to occur in an impact location in a more central location of the ballistic resistant panel assembly.

With the ballistic projectile being slowed down by the ballistic resistant plies, the process of stopping the ballistic projectile can promote separation of the ballistic resistant plies positioned near the impact location proximate the peripheral edge of the ballistic resistant panel assembly. Separation of the ballistic resistant plies provides less resistance to the ballistic projectile which may have a component of movement toward the peripheral edge of the ballistic resistant panel assembly.

There is a need to provide enhanced integrity to a ballistic resistant panel assembly in the peripheral edge portion so as to reduce and/or prevent ply separation within the ballistic resistant panel assembly and to facilitate capture of the ballistic projectile thereby optimizing the ballistic resistant panel assembly performance. At the same time of providing enhanced integrity, one needs to consider not imparting unnecessary stiffness to the ballistic resistant panel assembly.

SUMMARY

A ballistic resistant panel assembly includes a plurality of ballistic resistant plies positioned in a stack. Further included is a binding layer, wherein: a first portion of the binding layer extends along and overlying a first ballistic resistant ply of the stack; a second portion of the binding layer extends from the first portion of the binding layer and extends along peripheral edges of a less than all of the plurality of ballistic resistant plies in the stack; and a third portion of the binding layer extends from the second portion of the binding layer and extends along a second ballistic resistant ply of the stack, such that the second ballistic resistant ply is positioned between the first ballistic resistant ply and the third portion of the binding layer. The assembly further includes a plurality of stitches which extend through the first portion and the third portion of the binding layer and through the first ballistic resistant ply and the second ballistic resistant ply of the stack.

A method for fabricating a ballistic resistant panel assembly, includes positioning a plurality of ballistic resistant plies into a stack. The method further includes placing a binding layer wherein: a first portion of the binding layer extends along and overlies a first ballistic resistant ply, of the plurality of ballistic resistant plies; a second portion of the binding layer extends from the first portion of the binding layer and extends along peripheral edges of a less than all of the plurality of ballistic resistant plies in the stack; and a third portion of the binding layer extends from the second portion of the binding layer and extends along a second ballistic resistant ply of the stack, such that the second ballistic resistant ply is positioned between the first ballistic resistant ply and the third portion of the binding layer. The method further includes stitching a plurality of stitches through the first portion and the third portion of the binding layer and through the first ballistic resistant ply and the second ballistic resistant ply of the stack.

A ballistic resistant panel assembly which includes a plurality of ballistic resistant plies positioned in a stack. Further included is a binding layer, wherein: a first portion of the binding layer extends along and overlying a first ballistic resistant ply of the stack; a second portion of the binding layer extends from the first portion of the binding layer and extends along peripheral edges of a less than all of the plurality of the ballistic resistant plies in the stack; and a third portion of the binding layer extends from the second portion of the binding layer and extends along a second ballistic resistant ply of the stack, such that the second ballistic resistant ply is positioned between the first ballistic resistant ply and the third portion of the binding layer. In addition the ballistic resistant panel assembly includes a securement mechanism which binds together the first portion of the binding layer to the first ballistic resistant ply and the third portion of the binding layer to the second ballistic resistant ply.

A method for fabricating a ballistic resistant panel assembly, includes the step of positioning a plurality of ballistic resistant plies into a stack. The method further includes placing a binding layer, wherein: a first portion of the binding layer extends along and overlies a first ballistic resistant ply, of the plurality of ballistic resistant plies; a second portion of the binding layer extends from the first portion of the binding layer and extends along peripheral edges of a less than all of the plurality of ballistic resistant plies in the stack; and a third portion of the binding layer extends from the second portion of the binding layer and extends along a second ballistic resistant ply of the stack, such that the second ballistic resistant ply is positioned between the first ballistic resistant ply and the third portion of the binding layer. In addition, the method includes placing a securement mechanism which binds together the first portion of the binding layer to the first ballistic resistant ply and which binds the third portion of the binding layer to the second ballistic resistant ply.

The features, functions, and advantages that have been discussed can be achieved independently in various embodiments or may be combined in yet other embodiments further details of which can be seen with reference to the following description and drawings.

BRIEF SUMMARY OF THE DRAWINGS

FIG. 9 is a plan view of a third example of the plurality of ballistic resistant plies assembled of FIG. 2, which schematically represents a first version of the third example and schematically represents a second version of the third example, with the perimeter edge of the ballistic resistant panel encased;

FIG. 9A is a schematic cross section view along line 9A-9A of FIG. 9 which schematically represents the first version and schematically represents the second version of the third example of FIG. 9;

FIG. 10 is a plan view of a third version of the third example of the plurality of ballistic resistant plies assembled of FIG. 2 with the perimeter edge of the ballistic resistant panel encased;

FIG. 10A is a schematic cross section view along line 10A-10A of FIG. 10.

DESCRIPTION

As will be appreciated in the discussion herein, it is important to provide enhanced integrity to a ballistic resistant panel assembly proximate to a peripheral edge of the ballistic resistant panel assembly. Upon impact of a ballistic projectile proximate to the peripheral edge of the ballistic resistant panel, the enhanced integrity is needed to resist separation of the ballistic resistant plies proximate to the peripheral edge of the ballistic resistant panel and to facilitate capture of the ballistic projectile. An example of a ballistic resistant panel assembly that will be discussed herein as an example in which enhanced integrity is provided will be a front ballistic resistant panel assembly that is used within a ballistic resistant garment. The enhanced integrity discussed herein can be similarly applied to a back ballistic resistant panel assembly for a ballistic resistant garment or to other applicational uses of ballistic resistant panels, as mentioned earlier, such as used in association with hand-held shields, backpacks, extremity protection devices, vehicles, personnel enclosures and other applicational uses where ballistic projectile protection is needed.

The enhanced integrity of a ballistic resistant panel to be discussed herein will provide ballistic resistant plies of the ballistic resistant panel assembly to resist separation of ballistic resistant plies at a location proximate to the peripheral edge of a ballistic resistant panel assembly where impact of a ballistic resistant projectile has occurred and to facilitate capture of the ballistic projectile. Separation of the ballistic plies can occur with the ballistic projectile traveling either directly at the ballistic resistant panel assembly or traveling in an angular direction relative to the ballistic resistant panel. The enhanced integrity, which will be discussed herein, provides for binding together the ballistic resistant plies of the ballistic resistant panel proximate to the location of the impacting ballistic projectile which occurs at an edge portion of the ballistic resistant panel. Binding the ballistic resistant plies together resists separation of the ballistic resistant plies at the edge portion of the ballistic resistant panel assembly. The bound ballistic resistant plies provide a blocked pathway of the ballistic projectile which can have a component of movement toward the peripheral edge of the ballistic resistant panel assembly. The enhanced integrity additionally provides a binding layer secured to the ballistic resistant plies which encases the peripheral edges of ballistic resistant plies enclosing the peripheral edge of the ballistic resistant panel which further provides a blocked pathway of the ballistic projectile which has impacted the ballistic resistant panel and which has a component of movement toward the peripheral edge of the ballistic resistant panel assembly.

Figure 1:
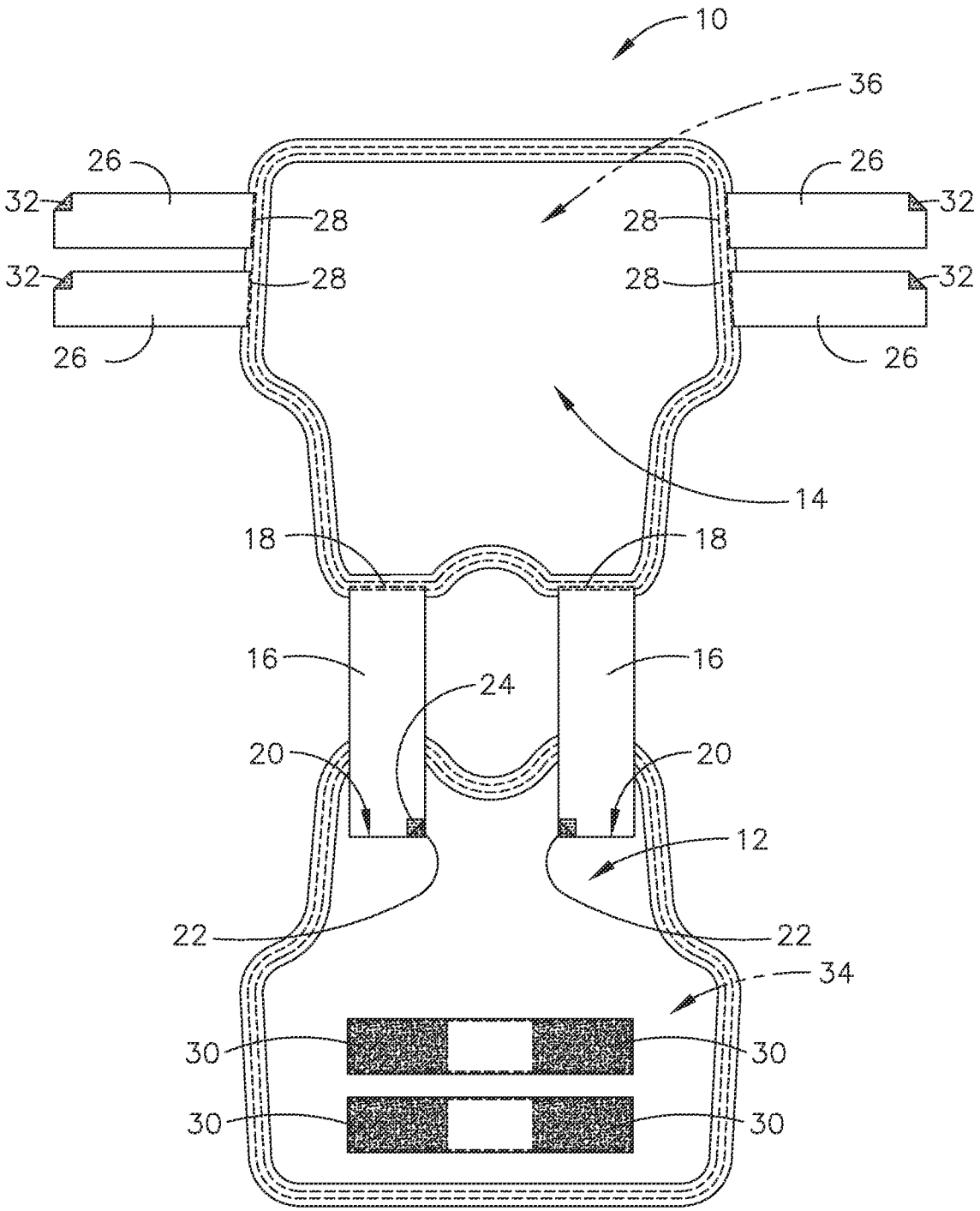
FIG. 1 is a plan view of an example of a concealable ballistic resistant panel carrier assembly.

An example of a ballistic resistant panel assembly, for discussion herein, will be a front ballistic resistant panel assembly used in association with concealable body armor carrier 10, as seen in FIG. 1. Concealable body armor carrier 10, includes front garment enclosure 12 and back garment enclosure 14 wherein each enclosure 12, 14 carry a ballistic resistant panel assembly. Shoulder straps 16 adjustably connect front garment enclosure 12 to back garment enclosure 14. In this example, ends 18 of shoulder straps 16 are secured in this example by way of stitching or by way any other way of fixed securement. Opposing ends 20 of shoulder straps 16 are adjustably secured to front garment enclosure 12. In this example, panels of flexible loop type fasteners 22 are secured to front garment enclosure 12 and corresponding straps 16 carry at least one panel of flexible hook type fasteners 24, which when panel of flexible hook type fasteners 24 are placed onto panel of flexible loop type fasteners 22, straps 16 are releasably secured to front garment enclosure 12. This arrangement secures both straps 16 to front garment enclosure 12 and allows the wearer to adjust the positioning of front and back garment enclosures 12, 14, relative to the wearer's torso.

Concealable carrier 10 is also secured to the wearer with use of side straps 26. Side straps 26 at one end 28 are secured to back garment enclosure 14 by way of stitching or by way of other common fixed securement methods. In this example, panel of flexible loop type fasteners 30 are secured to front garment enclosure 12 and straps 26 carry at least one panel of flexible hook type fasteners 32. With all four straps 26, in this example, positioned in a desired location, flexible hook type fasteners 32 are engaged with flexible loop type fasteners 30 positioned on front garment enclosure 12 providing the wearer a snug fit to wearer's torso.

Front ballistic resistant panel assembly 34 is positioned within front garment enclosure 12 and back ballistic resistant panel assembly 36 is positioned within back garment enclosure 14. Front ballistic resistant panel assembly 34 will be used as an example of a ballistic resistant panel assembly to which to employ the enhanced integrity to a ballistic resistant panel assembly, to be discussed herein, and which can be applied to other applications of use of ballistic resistant panels, as mentioned earlier, including that of back ballistic resistant panel assembly 34.

Figure 2:
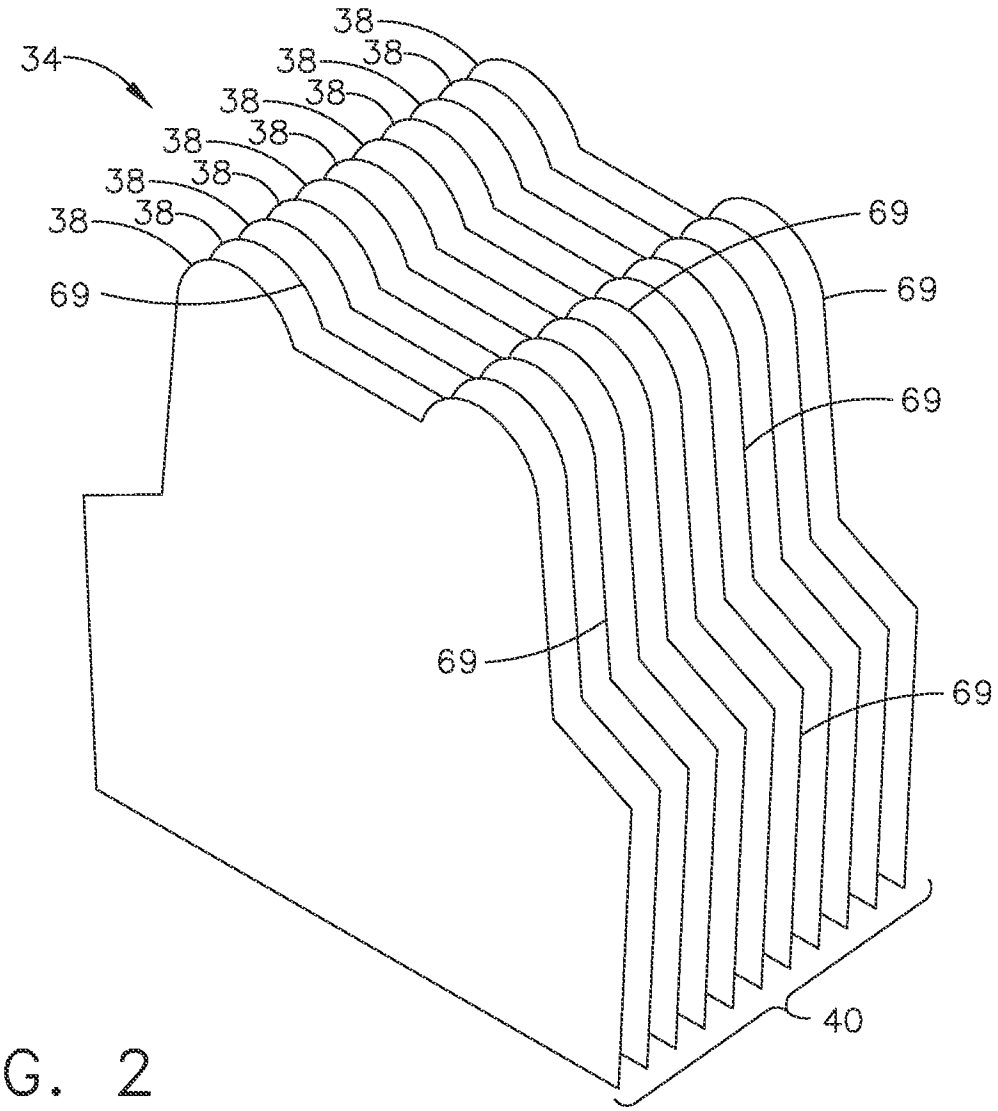
FIG. 2 is a schematic perspective exploded view of a plurality of ballistic resistant plies which form a front ballistic resistant panel assembly of the concealable ballistic resistant panel carrier assembly as seen in FIG. 1.
Figure 3:
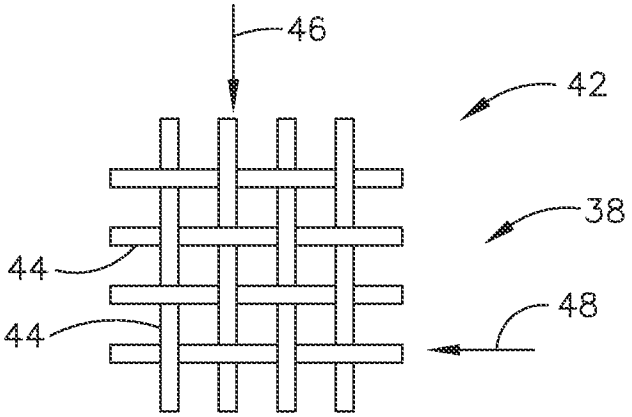
FIG. 3 is a schematic view of an example of a weave configuration for a ballistic resistant ply for a ballistic resistant panel assembly of FIG. 2.

In FIG. 2, an exploded view of ballistic resistant panel assembly 34 is schematically shown. Ballistic resistant panel assembly 34 is constructed of plurality of ballistic resistant plies 38 positioned within a stack 40. Ballistic resistant plies 38 can be made from a wide variety of different constructions. Such examples of construction include, as seen in schematic view of FIG. 3, ballistic resistant ply 38 being constructed of woven fibers 42 composed of high strength fibers 44 which are configured to extend in warp direction 46 and a weft direction 48 forming a fabric. Woven fibers 42 can be selected from a number of various weave constructions such as, for example, a plain weave as seen in FIG. 3, a sateen weave (not shown) and a variety of other weaves commonly employed in the construction of ballistic resistant plies 38 used for construction of ballistic resistant panel assembly 34. High strength fibers 44 are composed from a wide variety of high strength materials such as for example an aramid, an ultra-high molecular weight polyethylene (UHMWPE), or a carbon, or other compositions of high strength fibers used for ballistic resistant panel assembly construction. A wide variety of weave constructions and fiber compositions can be selected for the construction of ballistic resistant plies 38 to be used in the construction of ballistic resistant panel assembly 34. The selection of weave constructions and fiber compositions depend on the particular performance parameters that are needed for a particular ballistic resistant panel assembly 34.

Figure 4:
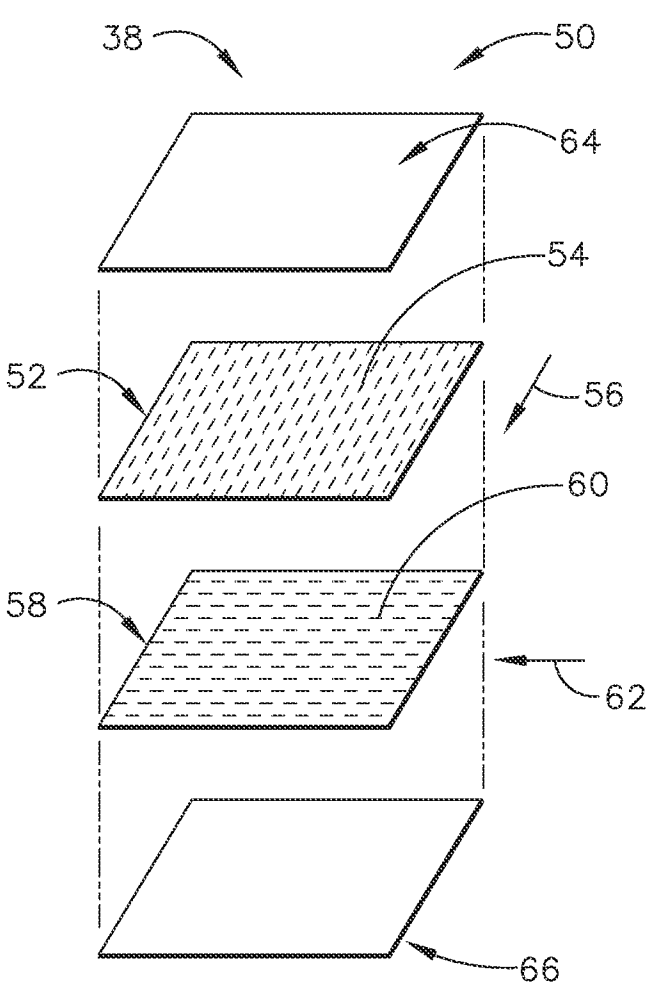
FIG. 4 is an exploded schematic view of a composite unidirectional fiber laminate for a ballistic resistant ply of FIG. 2.
Figure 4A:
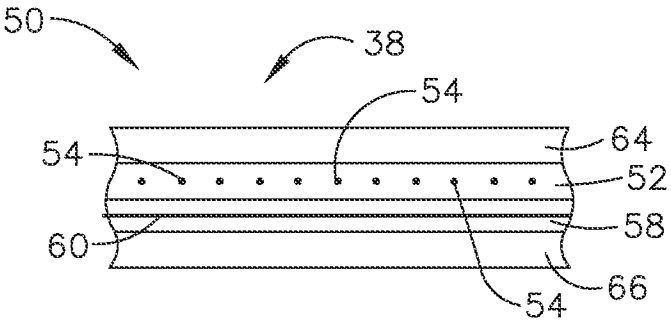
FIG. 4A is a schematic assembled view of the composite unidirectional fiber laminate for the ballistic resistant ply of FIG. 4.

Another example of a construction for ballistic resistant plies 38 used for constructing ballistic resistant panel assembly 34 includes utilizing at least one of ballistic resistant plies 38 being constructed of composite unidirectional fiber laminate 50. A schematic example of a ballistic resistant ply 38 constructed of composite unidirectional fiber laminate 50 is shown in FIGS. 4 and 4A. There are numerous different constructions of composite unidirectional fiber laminates 50. In the example shown in FIG. 4, composite unidirectional fiber laminate 50 includes at least one layer 52 which has a plurality of first fibers 54 which extend in first direction 56 and at least one layer 58 which have a plurality of second fibers 60 extend in a second direction 62, wherein first and second directions 56, 62 are generally transverse to one another. Depending on the composite unidirectional fiber laminate 50 selected to be used for the construction of a particular ballistic resistant ply 38, composite unidirectional fiber laminate 50 can have various numbers of different layers within its construction wherein each layer contains a plurality of fibers extending in a single direction. Generally, adjacent layers have fibers in each layer which extend in an angular or transverse direction relative to the fibers in the adjacent layer. First fibers 54 and second fibers 60 are selected from a wide variety of high strength fibers such as an aramid, or an ultra-high molecular weight polyethylene (UHMWPE) as well as other high strength fibers commonly used in the construction of ballistic resistant panels.

At least one layer 52 has plurality of first fibers 54 and at least one layer 58 has plurality of second fibers 60. In this schematic example, plurality of first fibers 54 are held together in at least one layer 52 with typically a very low modulus matrix often referred to as an clastic binder resin which is similar for the construction of at least one layer 58 with respect to plurality of second fibers 60. The layers containing fibers, such as, at least one layer 52 and at least one layer 58 are positioned in a sandwich arrangement between typically thin films 64, 66 which are constructed for example of a polyethylene and are laminated together securing together in this example at least one layer 52 and least one layer 58, as seen in FIG. 4A. An example of ballistic resistant plies 38 includes a composite unidirectional fiber laminate known as Dyneema® UD, a registered trademark of the Avient Corporation. A wide variety of different composite unidirectional fiber laminates can be selected to be ballistic resistant plies 38 of ballistic resistant panel assembly 34.

A wide variety of constructions can be selected for ballistic resistant plies 38 in constructing ballistic resistant panel assembly 34 which may include woven fabrics, composite unidirectional fiber laminates, or a combination thereof, depending on the performance parameters required for a particular ballistic resistant panel assembly 34.

Figure 5:
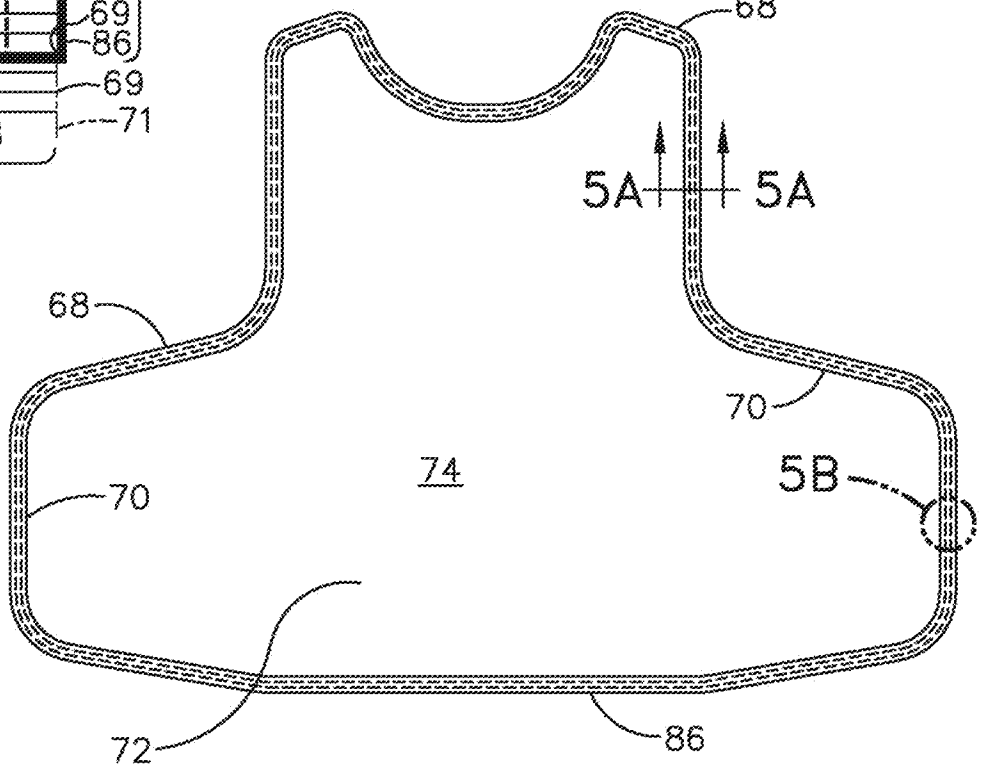
FIG. 5 is a plan schematic view of a first example of the plurality of ballistic resistant plies assembled of FIG. 2 with the perimeter edge of the ballistic resistant panel encased.
Figure 5A:
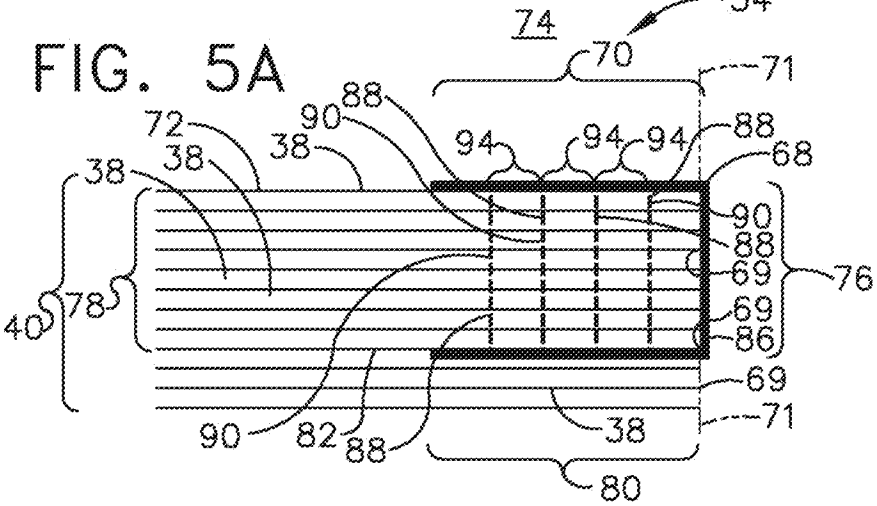
FIG. 5A is a cross section view along line 5A-5A of FIG. 5.
Figure 5B:
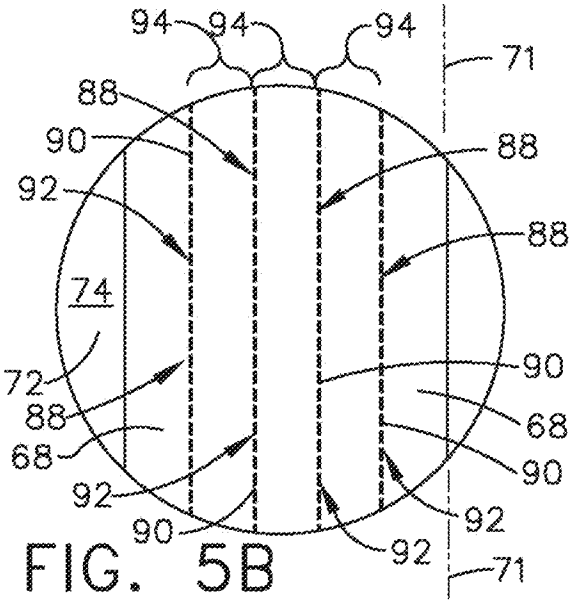
FIG. 5B is an enlarged view of that which is encircled and identified as FIG. 5B, in FIG. 5.

In referring to FIGS. 5-5B, a first example of ballistic resistant panel assembly 34 is shown which includes a plurality of ballistic resistant plies 38 positioned in stack 40, as seen in FIG. 2. In fabrication of a ballistic resistant panel assembly 34, ballistic resistant plies 38 can be positioned in stack 40 wherein ballistic resistant plies 38 are then cut to have a same size and shape. Other fabrication processes can have ballistic resistant plies 38 cut to have a same size and shape and then assembled into stack 40. Typically, ballistic resistant plies 38 of stack 40 are secured together to maintain ballistic resistant plies 38 in alignment with one another for completing the fabrication process. The securement of the ballistic resistant plies 38 can be accomplished in various ways such as using bar tacking, stitching or other commonly known ways to maintain a plurality of ballistic resistant plies 38 in alignment within stack 40. As seen in FIG. 2, ballistic resistant plies 38 have peripheral edges 69 which are generally aligned with each other and form peripheral stack edge 71 of plurality of ballistic resistant plies 38 about a perimeter 86 of ballistic resistant panel assembly 34, as seen by dashed line 71 of FIG. 5A. In addition, in this first example, binding layer 68, constructed of a strong flexible material such as a nylon, an aramid, a polyethylene such as (UHMWPE), or similarly strong flexible material is used to encase certain peripheral edges 69, as seen in FIGS. 2 and 5A, of ballistic resistant plies 38, as will be discussed in more detail below.

As seen in FIG. 5A, first portion 70 of binding layer 68 extends along and overlying first ballistic resistant ply 72 of plurality of ballistic resistant plies 38 of stack 40. First ply 72, in this example, is positioned on an exterior side or strike side 74 of stack 40 of plurality of ballistic resistant plies 38 and ballistic resistant panel assembly 34. It should be clearly understood that for purposes of this disclosure first ballistic resistant ply 72 is merely an identification of a ballistic resistant ply 38 in stack 40 and is not an indication of a particular position occupied of first ballistic resistant ply 72 within stack 40. It is understood, that first ballistic resistant ply 72 can be positioned within stack 40 such that a different ballistic resistant ply 38 within stack 40 is positioned at the exterior side or strike side 74 of stack 40. It just so happens that the example shown in FIG. 5A, has first ballistic resistant panel 72 positioned at the exterior side or strike side 74 of stack 40. A second portion 76 of binding layer 68 extends from first portion 70 of binding layer 68 and extends along peripheral edges 69 of a less than all 78 of plurality of ballistic resistant plies 38 in stack 40. Second portion 76, depending on how taut the securement of binding layer 68 is made with respect to ballistic resistant panel assembly 34 and depending on the length of ballistic resistant plies 38, will determine whether second portion 76 of binding layer 68 is in contact with any peripheral edge 69 of ballistic resistant plies 38 positioned within less than all 78 of plurality of ballistic resistant plies 38 of stack 40. Third portion 80 of binding layer 68, as seen in FIG. 5A, extends from second portion 76 and extends along second ballistic resistant ply 82 of the plurality of ballistic resistant plies 38 in stack 40. Second ballistic resistant ply 82 is positioned between first ballistic resistant ply 72 and the third portion 80 of binding layer 68, as seen in FIG. 5A. In this example, binding layer 68, which includes second portion 76 of binding layer 68, as seen in FIG. 5A, extends about perimeter 86 of ballistic resistant panel assembly 34, as seen in FIG. 5. As a result, second portion 76 overlies peripheral edges 69 of ballistic resistant plies 38 of less than all 78 of the ballistic resistant plies 38 in stack 40. In this example, binding layer 68 encases peripheral edges 69 of ballistic resistant plies 38 of less than all 78 of the ballistic resistant plies 38 in stack 40 and extends about perimeter 86 of ballistic resistant panel assembly 34.

Ballistic resistant panel assembly 34 further includes a plurality of stitches 90, which includes thread member 88 which will be discussed further below. Plurality of stitches 90 extend through first portion 70 of binding layer 68 and third portion 80 of binding layer 68, as well as, extending through first ballistic resistant ply 72 and second ballistic resistant ply 82 of stack 40. In this example, plurality of stitches 90 also extend through any ballistic resistant plies 38 positioned between first and second ballistic resistant plies 72, 82, as seen in the example in FIG. 5A. Plurality of stitches 90 in this example include a configuration of rows 92 of stitches 90 which extend along and spaced apart from peripheral stack edge 71 of ballistic resistant plies 38 of ballistic resistant panel assembly 34 and spaced apart from one another, as indicated by space 94, as seen in FIGS. 5A-5B. The stitching binds together first ballistic resistant ply 72 and second ballistic resistant ply 82 as well as any other ballistic resistant plies 38 positioned between first and second ballistic resistant plies 72, 82. This stitching construction further secures binding layer 68 to first and second ballistic resistant plies 72, 82 and, as in this example, any ballistic resistant plies 38 positioned therebetween, and encases, with binding layer 68, peripheral edges 69 of these same ballistic resistant plies 38 being first and second ballistic resistant plies 72, 82 and of any ballistic resistant plies 38 positioned between first and second ballistic resistant plies 72, 82. Binding layer 68, which includes second portion 76, as seen in FIGS. 5 and 5A extends about perimeter 86 of ballistic resistant panel assembly 34 encasing and overlying peripheral edges 69 of the less than all 78 of the ballistic resistant plies 38 in stack 40.

With binding together less than all 78 of ballistic resistant plies 38 in stack 40 with rows 92 of stitches 90, in this example, and encasing peripheral edges 69 of ballistic resistant plies 38 with binding layer 68 of less than all 78 of ballistic resistant plies 38 in stack 40, such construction provides less potential stiffening from being imparted to ballistic resistant panel assembly 34, in contrast to binding together all ballistic resistant plies 38 in stack 40. At the same time, such construction provides enhanced integrity to ballistic resistant panel 34 in providing resistance to separation of adjacent ballistic resistant plies 38 within less than all 78 of ballistic resistant plies 38 of stack 40 and with encasing the peripheral edges 69 of ballistic resistant plies 38 of less than all of 78 ballistic resistant plies 38. This construction thereby facilitates capture of a ballistic projectile within ballistic resistant panel assembly 34, which has impacted ballistic resistant panel assembly 34 proximate to peripheral stack edge 71 with binding together of ballistic resistant plies 38 within the less than all 78 of the ballistic resistant plies 38 by rows 92 of stitches 90, in the example shown in FIGS. 5A and 5B and with utilizing binding layer 68 secured and positioned encasing peripheral edges 69 of the ballistic resistant plies in less than all 78 of stack 40.

In fabricating ballistic resistant panel assembly 34, the manufacturer can provide a sufficient number of ballistic resistant plies 38, with respect to less than all 78 of plurality of ballistic resistant plies 38, to slow down and resist further penetration of ballistic resistant panel assembly 34 for a particular level of threat. The less than all 78 of plurality of ballistic resistant plies 38 can be encased with binding layer 68 and stitched or otherwise bound together, as discussed herein. Depending on the threat level being addressed by ballistic resistant panel assembly 34, two to four or more rows 92 of stitches 90 can be employed which provide a binding of the less than all 78 ballistic resistant plies 38 and provide securement of binding layer 68 to less than all 78 of plurality of ballistic plies 38, encasing peripheral edges 69 of the less than all 78 ballistic resistant plies 38.

Capture of the ballistic resistant projectile which impacts ballistic resistant panel 34 is facilitated with the use of a strong thread member 88 used in the plurality of stitches 90 which is constructed of a strong material such as nylon, aramid, polyethylene or other comparably strong material. In this example, a nylon thread is used which is designated commercially as "Tex 70" and which is positioned in this example with eight stitches per inch. The size of the nylon or other material and the number of stitches can be varied to accommodate the strength of binding needed for confronting a particular level of threat. In addition to the strength of the thread and number of stitches employed, it is beneficial to employ a configuration of stitching which includes rows 92 of stitches 90 which extend along spaced apart from peripheral stack edge 71 of plurality of ballistic resistant plies 38 of ballistic resistant panel 34, as seen in the example shown in FIGS. 5A-5B, and spaced apart 94 from one another.

This example of stitching shown in this first example of ballistic resistant panel assembly 34, in FIGS. 5-5B, includes four rows 92 of stitches 90 which extend spaced apart 94 from each adjacent row 92. The number of rows 92 of stitches 90 employed depends on a threat level to be confronted by the ballistic resistant panel assembly 34. In this example, ballistic resistant panel 34 assembly is designed to confront threat level IIIA and utilizes four rows 92 of stitches 90 which extend along spaced apart 94 from one another and spaced from peripheral stack edge 71 of ballistic resistant plies 38 of ballistic resistant panel assembly 34. A lesser number of rows 92 may be employed for lesser threat levels such as two rows 92 for a ballistic resistant panel assembly 34 which needs to confront a level IIA threat level. The configuration of having rows 92 of stitches 90 which extend along and spaced apart from peripheral stack edge 71 of the plurality of ballistic resistant plies of ballistic resistant panel 34 assembly and spaced apart from one another, provides a sufficient binding of ballistic resistant plies 38 and encasement securement of binding layer 68 so as to facilitate capture of a ballistic projectile within ballistic resistant panel 34 which has impacted ballistic resistant panel assembly 34 proximate to peripheral stack edge 71 of ballistic resistant plies 38 of ballistic resistant panel assembly 34.

It should also be understood that many different types and configurations of stitches may be used in securing ballistic resistant plies 38 and binding layer 68 together. A wide variety of stitches can be used such as straight, zigzag, chain, outline, running, satin, tack as well as many other commonly used stitches. The positioning of these types of stitches in rows 92 of stitches 90 spaced apart from one another and spaced apart from peripheral stack edge 71 of the plurality of ballistic resistant plies 38 provides sufficient binding of less than all 78 of ballistic resistant plies 38 and binding of binding layer 68 to less than all 78 of the ballistic resistant plies 38 to facilitate capture of ballistic projectile.

Figure 6:
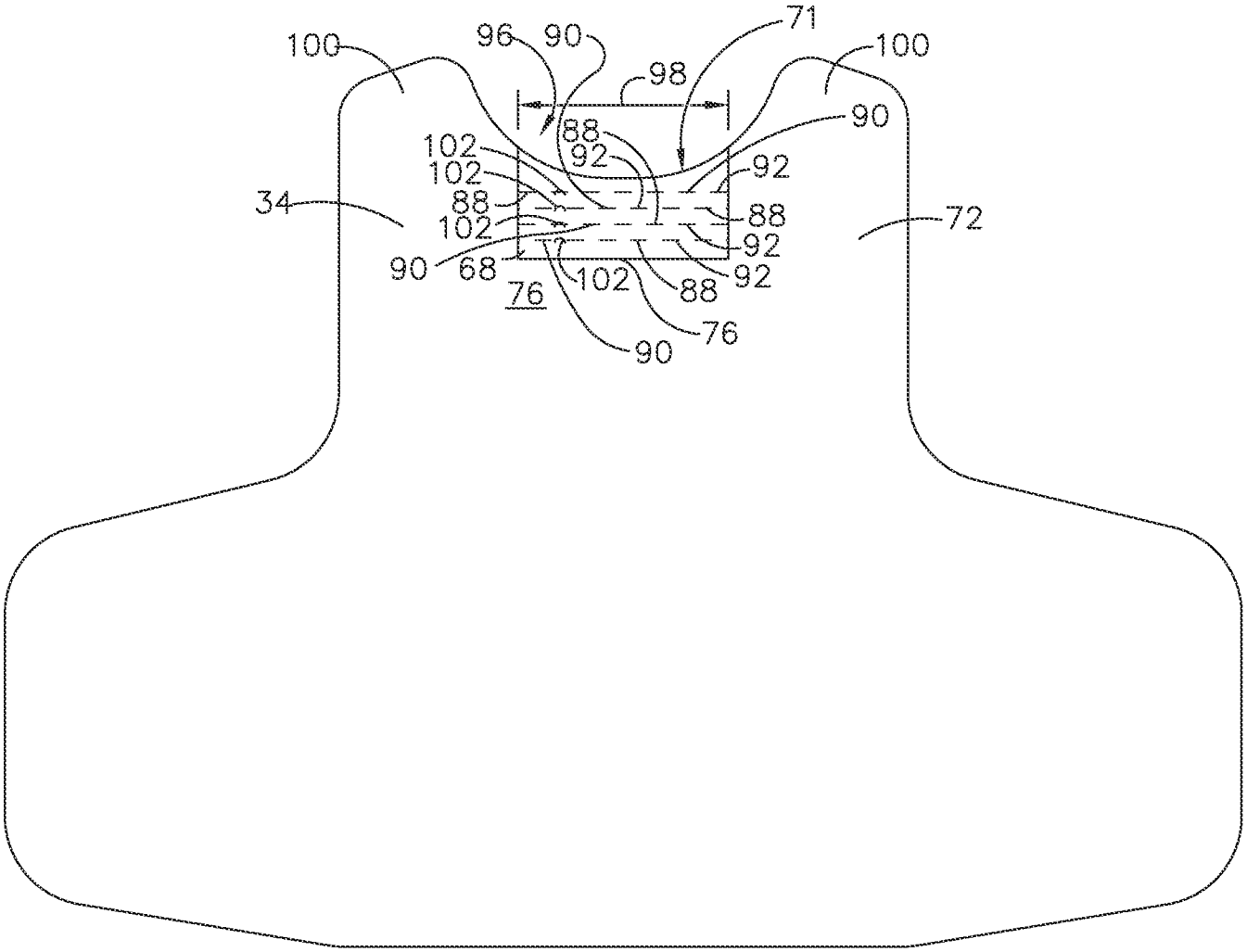
FIG. 6 is a plan view of a second example of the plurality of ballistic resistant plies assembled of FIG. 2 with a portion of the perimeter edge in the neck region of the ballistic resistant panel encased.

A second example of ballistic resistant panel assembly 34 is seen in FIG. 6. The configuration of providing enhanced integrity to ballistic resistant panel 34 proximate to peripheral stack edge 71 of neck area 96 of ballistic resistant panel assembly 34. The second example of ballistic resistant panel 34 in FIG. 6, is similar in construction to that of the first example of ballistic resistant panel assembly 34 as seen in FIGS. 5A-5B in which the enhanced integrity is positioned about the perimeter of ballistic resistant panel 34 assembly, except for the enhanced integrity in FIG. 6 is positioned localized to neck area 96 of a front ballistic resistant panel 34. Thus, in the following description of this second example of ballistic resistant panel assembly 34 in FIG. 6, the description will also utilize that which is shown in FIGS. 5A-5B. Second portion 76 of binding layer 68, as seen in FIG. 5A-6, extends along peripheral edges 69 of less than all 78 of ballistic resistant plies 38 of stack 40. In this second example, second portion 76 of binding layer 68 has a length 98 positioned and extending between two shoulder portions 100 of front ballistic resistant panel assembly 34, as seen in FIG. 6. In this second example, plurality of stitches 90 are stitched forming a configuration of rows 92 of stitches 90 which extend along and spaced apart from peripheral stack edge 71 of ballistic resistant panel assembly 34 and spaced 94 apart from one another as seen in the example shown in FIGS. 5A-5B. The number of rows 92 of stitches 90 employed in this second example depends on the threat level to be confronted as discussed earlier with respect to the first example above. In FIG. 6, each row 92 of stitches 90 includes a back stitch 102 to inhibit the row of stitches from unraveling.

Figure 7:
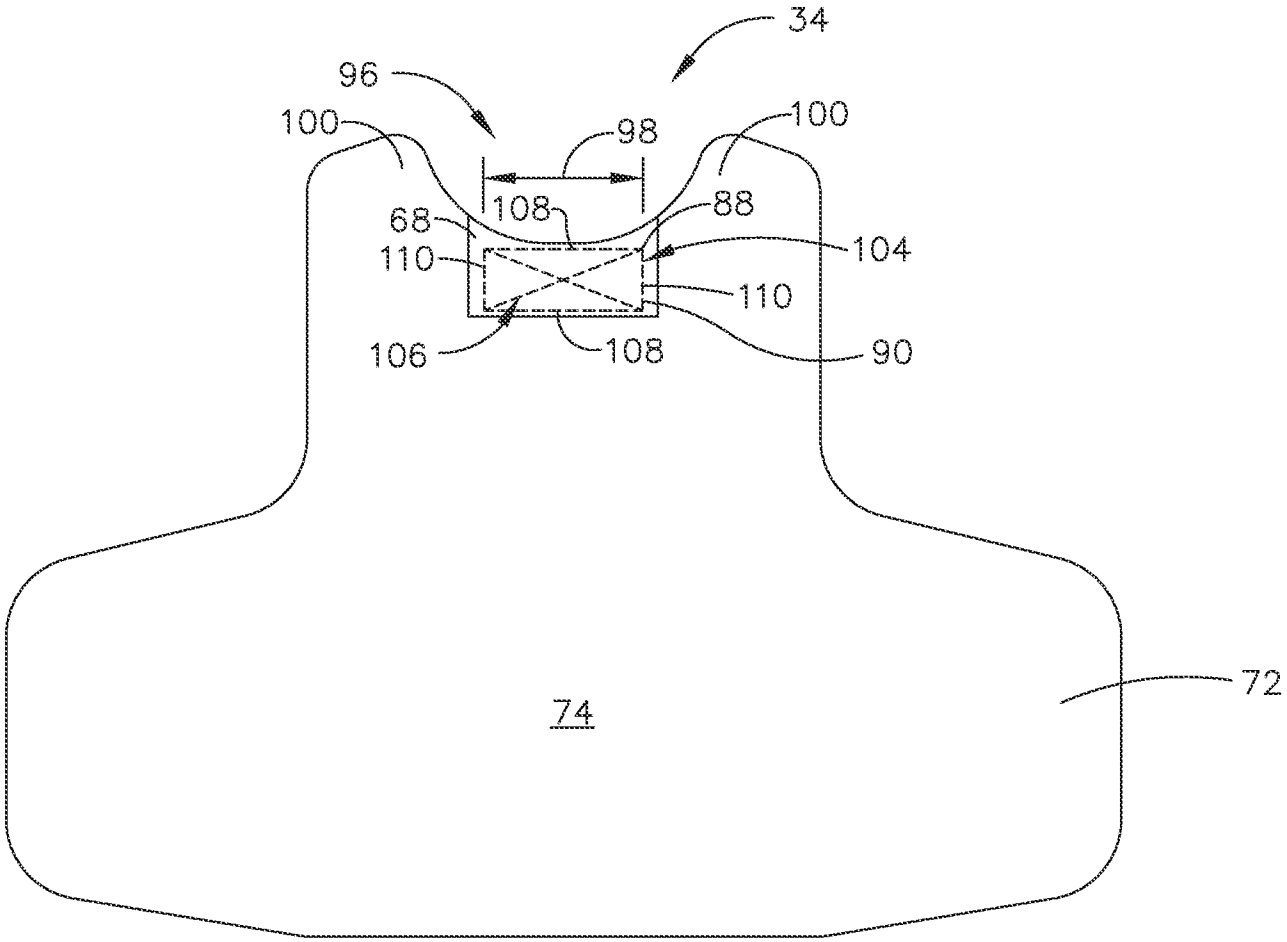
FIG. 7 is an example of use of a different stitching configuration with respect to the second example of the plurality of ballistic resistant plies assembled of FIG. 2 with a portion of the perimeter edge of the neck region of the ballistic resistant panel encased as shown in FIG. 6.

Another example of the second example, of ballistic resistant panel assembly 34 which was discussed above and shown in FIG. 6, is shown in FIG. 7. This another example is similar to the second example of FIG. 6. the enhanced integrity is positioned in the neck area 96 of ballistic resistant panel assembly 34 except the stitching configuration of thread member 88 in this another example is different. Plurality of stitches 90 are stitched forming a configuration of stitches 90 of a rectangular box configuration 104 with an "x" configuration 106 positioned within the rectangular box configuration 104. The opposing rows of stitching 108 provide spaced apart rows of stitching as discussed earlier, which are spaced apart from one another and spaced apart from peripheral stack edge 71, as seen in FIG. 5A, but in addition this another example provides opposing end rows 110 and "x" configuration 106 of stitches which extend between opposing rows of stitching 108 and provide additional integrity enhancement for this another example.

Figure 8:
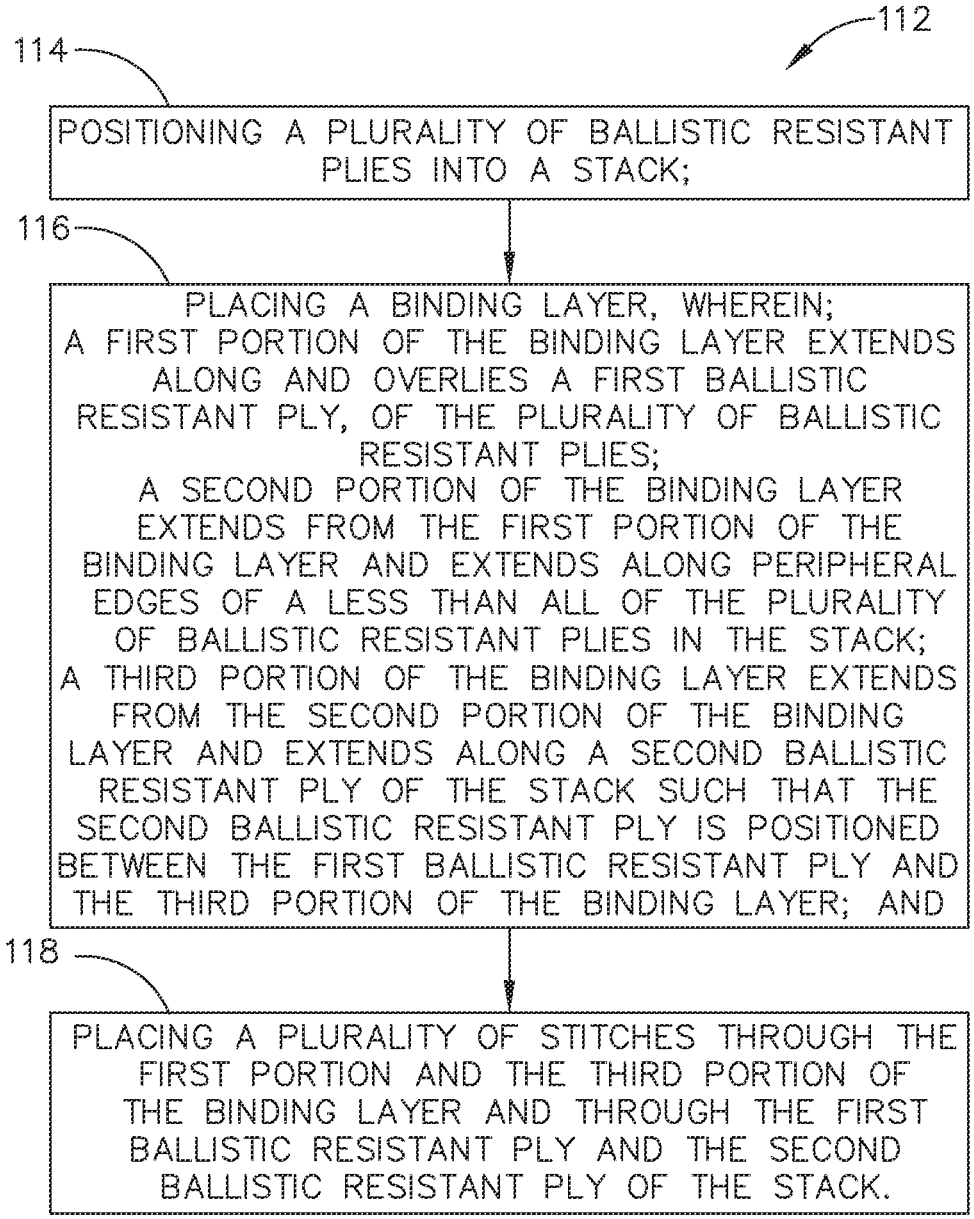
FIG. 8 is a flow chart of a first method for fabricating the ballistic resistant panel.

In referring to FIG. 8, first method 112 for fabricating a ballistic resistant panel assembly 34 is shown. Method 112 includes positioning 114 a plurality of ballistic resistant plies 38 in stack 40 and further includes placing 116 binding layer 68 wherein first portion 70 of binding layer 68 extends along and overlies first ballistic resistant ply 72 of ballistic resistant plies as seen in FIG. 5A. In this example, first ballistic resistant ply 72 is positioned on an exterior side or strike side 74 of stack 40. As mentioned earlier, it should be understood, that first ballistic resistant ply 72 identifies a ballistic resistant ply 38 in stack 40 and is not an indication of a particular position occupied by first ballistic resistant ply 72 within the stack 40. It is understood that first ballistic resistant ply 72 can be positioned within stack 40 such that a different ballistic resistant ply 38 within stack 40 is positioned at the exterior side or strike side 74 of stack 40. It just so happens that the example shown in FIG. 5A has first ballistic resistant ply 72 positioned at the exterior side or strike side 74 of stack 40. Binding layer 68 further includes second portion 76 which extends from first portion 70 of binding layer 68 and extends along peripheral edges 69 of less than all 78 of plurality of ballistic resistant plies 38 in stack 40. Third portion 80 of binding layer 68 extends from second portion 76 of binding layer 68 and extends along second ballistic resistant ply 82 of stack 40, such that the second ballistic resistant ply 82 is positioned between the first ballistic resistant ply 72 and the third portion 80 of the binding layer 68, as seen in FIG. 5A. Method 112 further includes placing a plurality of stitches 118 through first portion and third portion 70, 76 of binding layer 68 and through first ballistic resistant ply 72 and second ballistic resistant ply 82. This stitching configuration in this example also has plurality of stitches 118 extending through ballistic resistant plies 38 positioned between first ballistic ply 72 and second ballistic ply 82 securing less than all 78 ballistic resistant plies 38 together with binding layer 68 with binding layer 68 encasing peripheral edges 69 of ballistic resistant plies 38 within less than all 78 of ballistic resistant plies 38 in stack 40.

As discussed earlier, at least one ply of plurality of ballistic resistant plies 38 is constructed of woven fibers 42 composed of high strength fibers 44, as shown in FIG. 3, or at least one ply of plurality of ballistic resistant plies 38 is constructed of composite unidirectional fiber laminate 50 as seen in FIGS. 4-4A.

Placing 116 binding layer 68, in the first example of ballistic resistant panel assembly 34, further includes positioning second portion 76 of binding layer 68 about perimeter 86, as seen in FIG. 5, of ballistic resistant panel assembly 34 overlying less than all 78 of ballistic resistant plies 38 peripheral edges 69 in stack 40. Placing 118 plurality of stitches 90 includes in this first example forming a configuration of rows 92 of stitches 90 which extend along and spaced apart from peripheral stack edge 71 of plurality of ballistic resistant plies 38 of ballistic resistant panel assembly 34 and spaced apart 94 from one another, as seen for example in FIG. 5A.

In the second example of ballistic resistant panel assembly 34 discussed earlier and seen in FIG. 6, second portion 76 of binding layer 68 extends along peripheral edges 69 of less than all 78 of the plurality of ballistic resistant plies 38 in stack 40 with second portion 76 having a length 98 positioned and extending between two shoulder portions 100 of a front ballistic resistant panel assembly 34. Placing 118 plurality of stitches 90 for this second example can take on various stitching configurations. Placing 118 plurality of stitches 90, as similar to what is shown in FIGS. 5A-5B, can include having stitches 90 forming a configuration of rows 92 of stitches 92 which extend along and spaced apart from peripheral stack edge 71 of ballistic resistant plies 38 of ballistic resistant panel assembly 34 and spaced 94 apart from one another, as seen for example in FIGS. 5B-6. In this example, each row 92 of stitches 90, as seen in FIG. 6, includes back stitch 102, as schematically indicated in FIG. 6, which inhibits each row 92 of stitches 90 from unraveling. In an another example, of the second example of ballistic resistant panel 34 of a configuration for placing 118 plurality of stitches 90, is seen in FIG. 7. This another example includes placing 118 plurality of stitches 90 to form a configuration, as seen in FIG. 7, which includes rectangular box configuration 104 with an "x" configuration 106 positioned within rectangular box configuration 104, as discussed in more detail earlier.

With respect to a third example of ballistic resistant panel assembly 34, three versions of the third example, can be seen in FIGS. 9-10A. All three versions of the third example of ballistic resistant panel assembly 34 has similar construction as described above with respect to the first example of ballistic resistant panel assembly 34 shown in FIGS. 5 and-5A. However, unlike the first example, the three versions of the third example do not employ a plurality of stitches 90 which extend through first portion 70 and third portion 80 of binding layer 68 and through first ballistic resistant ply 72 and second ballistic resistant ply 82 of less than all 78 of ballistic resistant plies 38 of stack 40, as seen in FIGS. 5 and 5B. Instead, the third example includes securement mechanism 120, which has two versions which are shown schematically in FIG. 9A and a third version shown in FIG. 10A, which is utilized for binding together first portion 70 of binding layer 68 to first ballistic resistant ply 72 and third portion 80 of binding layer 68 to second ballistic resistant ply 82. The identification numbers within FIGS. 9, 9A, 10, and 10A, of the three versions of this third example of ballistic resistant panel assembly 34, which are the same as seen in the first example of ballistic resistant panel assembly 34 in FIGS. 5 and 5A are the same parts as identified and described earlier with respect to the first example shown in FIGS. 5 and 5A and are herein incorporated for the three versions of the third example of the ballistic resistant panel assembly 34 as seen in FIGS. 9, 9A, 10, and 10A.

In a first version of the third example, securement mechanism 120 includes adhesive layer 122 positioned between first portion 70 of binding layer 68 and first ballistic resistant ply 72 and positioned between third portion 80 of binding layer 68 and second ballistic resistant ply 82, as seen in FIG. 9A. Additionally, in this example, adhesive layer 122 is positioned between adjacent ballistic resistant plies 38 positioned between first ballistic resistant ply 72 and second ballistic resistant ply 82. Adhesive layer 122 extends in this example from proximate to peripheral edge 69 of ballistic resistant plies 38 and away from peripheral edge 69 of ballistic resistant plies 38. Adhesive material for adhesive layer 122 can be selected from a variety of adhesive materials such as an epoxy or an urethane based adhesive or other known adhesive materials for binding ballistic resistant plies 38 to a binding layer 68 and for binding together ballistic resistant plies 38 to one another.

Second version of the third example of ballistic resistant panel assembly panel 34 can also be seen schematically in FIGS. 9-9A. This second version of the third example of ballistic resistant panel assembly 34 is similarly constructed as described above with respect to the first example of FIGS. 5-5A, however, this second version of the third example, as mentioned above with respect to the first version of the third example, does not utilize a plurality of stitches 90 which extend through first portion 70 and third portion 80 of binding layer 68 and through first ballistic resistant ply 72 and second ballistic resistant ply 82 of less than all 78 of ballistic resistant plies 38 of stack 40, as seen in FIGS. 5 and 5B. Instead, second version of the third example includes securement mechanism 120, as seen in FIG. 9A, which is utilized for binding together first portion 70 of binding layer 68 to first ballistic resistant ply 72 and third portion 80 of binding layer 68 to second ballistic resistant ply 82. The identification numbers within FIGS. 9 and 9A of this second version of the third example of ballistic resistant panel assembly 34 which are the same as seen in FIGS. 5 and 5A are the same parts as identified and described earlier with respect to FIGS. 5 and 5A and are herein incorporated for FIGS. 9 and 9A.

In the second version of the third example, securement mechanism 120 includes compression heated molded layer 124, which occupies the similar schematic position of previously identified adhesive layer 122, positioned between first portion 70 of binding layer 68 and first ballistic resistant ply 72 and positioned between third portion 80 of binding layer 68 and second ballistic resistant ply 82. Additionally, in this example compression heated molded layer 124 is positioned between adjacent ballistic resistant plies 38 positioned between first ballistic resistant ply 72 and second ballistic resistant ply 82. Compression heated molded layer 124 extends, in this example, from proximate to peripheral edge 69 of ballistic resistant plies 38 and away from peripheral edge 69 of ballistic resistant plies 38. Compression heated molded layer 124 can be selected from various materials such as a polyurethane film and other known materials utilized to form a compression heated molded layer which binds ballistic resistant plies 38 to a binding layer 68 and for binding together ballistic resistant plies 38 to one another.

Third version of the third example of ballistic resistant panel assembly panel 34 can be seen in FIGS. 10-10A. This third version of the third example of ballistic resistant panel assembly 34 is similarly constructed as described above with respect to the first example of FIGS. 5-5A, however, this third version of the third example, as mentioned above with respect to the first and second versions of the third example, does not utilize a plurality of stitches 90 which extend through first portion 70 and third portion 80 of binding layer 68 and through first ballistic resistant ply 72 and second ballistic resistant ply 82 of less than all 78 of ballistic resistant plies 38 of stack 40, as seen in FIGS. 5 and 5B. Instead, third version of the third example includes securement mechanism 120, as seen in FIGS. 10 and 10A, which is utilized for binding together first portion 70 of binding layer 68 to first ballistic resistant ply 72 and third portion 80 of binding layer 68 to second ballistic resistant ply 82. The identification numbers within FIGS. 10 and 10A of this third version of the third example of ballistic resistant panel assembly 34 which are the same as seen in FIGS. 5 and 5A are the same parts as identified and described earlier with respect to FIGS. 5 and 5A and are herein incorporated for FIGS. 10 and 10A.

In the third version of the third example, securement mechanism 120 includes plurality of rivets 126, which extends through first portion 70 of binding layer 68, first ballistic resistant ply 72, second ballistic resistant ply 82, and third portion 80 of binding layer 68 binding these items together. Additionally, in this example plurality of rivets 126 extends through a plurality of ballistic resistant plies 38 positioned between first ballistic resistant ply 72 and second ballistic resistant ply 82 binding together, binding layer 68 and ballistic resistant plies positioned between the first portion 70 and the third portion 80 of the binding layer 68. The plurality of rivets are positioned proximate to peripheral edges 69 of the ballistic resistant plies 38. The plurality of rivets 126 are also positioned spaced apart about a peripheral edge portion of ballistic resistant panel assembly 34 as seen in FIG. 10. Plurality of rivets 126 can be selected from known rivets utilized in clothing fabrication.

It can be appreciated that anyone of the above-described securement mechanism 120 including adhesive layer 122, compression heated molded layer 124 or plurality of rivets 126 can be applied in the neck area 96 between shoulder portions 100 of front ballistic resistant panel assembly, as seen in FIGS. 6 and 7 in place of plurality of stitches 90. Securement mechanism 120 can be employed to bind together first portion 70 of binding layer 68, first ballistic resistant ply 72 (as seen in FIG. 5A), second ballistic resistant ply 82 (as seen in FIG. 5A) and third portion 80 of binding layer 68, as well as, bind together with any ballistic resistant plies that may be positioned between first and second ballistic resistant plies 72, 82.

Figure 11:
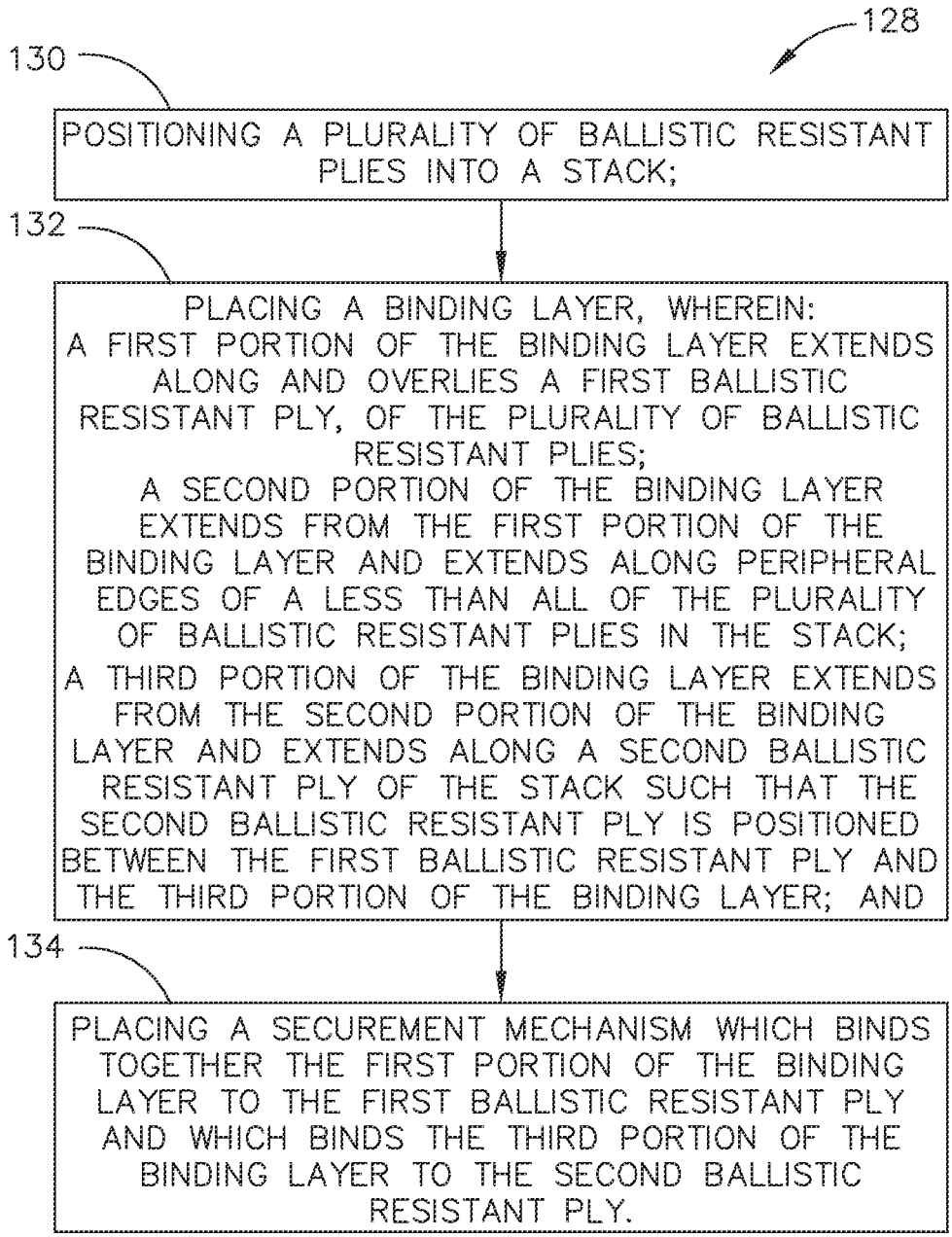
FIG. 11 is a flow chart of a second method for fabricating the ballistic resistant panel.

Second method 128 for fabricating a ballistic resistant panel assembly 34 can be seen in FIG. 11. Second method 128 includes positioning 130 a plurality of ballistic resistant plies 38 into stack 40. In addition, second method 128 includes placing a binding layer 68, wherein: a first portion 70 of binding layer 68 extends along and overlies first ballistic resistant ply 72, of the plurality of ballistic resistant plies 38; a second portion 76 of binding layer 68 extends from first portion 70 of binding layer 68 and extends along peripheral edges 69 of a less than all 78 of the plurality of ballistic resistant plies 38 in stack 40; and a third portion 80 of binding layer 68 extends from the second portion 76 of the binding layer 68 and extends along second ballistic resistant ply 82 of stack 40, such that the second ballistic resistant ply 82 is positioned between the first ballistic resistant ply 72 and the third portion 80 of the binding layer 68. Second method 128 further includes placing securement mechanism 120 which binds together first portion 70 of the binding layer 68 to the first ballistic resistant ply 72 and which binds the third portion 80 of binding layer 68 to second ballistic resistant ply 82.

The second method 128 includes fabricating of a first version of a third example of ballistic resistant panel assembly 34 wherein securement mechanism 120 includes an adhesive layer 122 positioned between first portion 70 of binding layer 68 and first ballistic resistant ply 72 and positioned between third portion 80 of binding layer 68 and second ballistic resistant ply 82. In the example shown in FIG. 9A, adhesive layer 122 is also positioned between adjacent ballistic resistant plies 38 positioned between first ballistic resistant ply 72 and second ballistic resistant ply 82.

The second method 128 includes fabricating of a second version of a third example of ballistic resistant panel assembly 34 wherein securement mechanism 120 includes a compression heated molded layer 124 positioned between first portion 70 of binding layer 68 and first ballistic resistant ply 72 and positioned between third portion 80 of binding layer 68 and second ballistic resistant ply 82 as also seen in FIG. 9A. In the example shown in FIG. 9A compression heated molded layer 124 is positioned between adjacent ballistic resistant plies 38 positioned between first ballistic resistant ply 72 and second ballistic resistant ply 82.

The second method 128 includes fabricating of a third version of a third example of ballistic resistant panel assembly 34 wherein securement mechanism 120 includes a plurality of rivets 126 which extend through first portion 70 of binding layer 68, first ballistic resistant ply 72, second ballistic resistant ply 82 and third portion 80 of binding layer 68 binding these items together. Additionally, in this example plurality of rivets 126 extends through a plurality of ballistic resistant plies 38 positioned between first ballistic resistant ply 72 and second ballistic resistant ply 82 binding together, binding layer 68 and ballistic resistant plies positioned between the first portion 70 and the third portion 80 of the binding layer 68, as seen in FIG. 10A.

While various embodiments have been described above, this disclosure is not intended to be limited thereto. Variations can be made to the disclosed embodiments that are still within the scope of the appended claims.

What is claimed:

1. A ballistic resistant panel assembly, comprising:

a plurality of ballistic resistant plies positioned in a stack;

a binding layer, wherein:

a first portion of the binding layer extends along and overlying a first ballistic resistant ply of the stack;

a second portion of the binding layer extends from the first portion of the binding layer and extends along peripheral edges of a less than all of the plurality of the ballistic resistant plies in the stack; and a third portion of the binding layer extends from the second portion of the binding layer and extends along a second ballistic resistant ply of the stack, such that the second ballistic resistant ply is positioned between the first ballistic resistant ply and the third portion of the binding layer; and a plurality of stitches which extend through the first portion and the third portion of the binding layer and through the first ballistic resistant ply and the second ballistic ply of the stack.

2. The ballistic resistant panel assembly of claim 1, wherein at least one ballistic resistant ply of the plurality of ballistic resistant plies comprises woven fibers.

3. The ballistic resistant panel assembly of claim 2, wherein the woven fibers comprise one of an aramid or ultra-high molecular weight polyethylene.

4. The ballistic resistant panel assembly of claim 1, wherein at least one ballistic resistant ply of the plurality of ballistic resistant plies comprises a composite unidirectional fiber laminate.

5. The ballistic resistant panel assembly of claim 4, wherein:

the composite unidirectional fiber laminate includes at least one layer of a plurality of first fibers which extend in a first direction and at least one layer which includes a plurality of second fibers which extend in a second direction; and the first direction is transverse to the second direction.

6. The ballistic resistant panel assembly of claim 5, wherein the at least one layer of the plurality of first fibers which extend in the first direction and the at least one layer of the plurality of second fibers which extend in the second direction comprise one of an aramid or an ultra-high molecular weight polyethylene.

7. The ballistic resistant panel assembly of claim 1, wherein the first ballistic resistant ply is positioned on an exterior side of the stack.

8. The ballistic resistant panel assembly of claim 1, wherein the binding layer comprises a composition of one of nylon, aramid, or polyethylene.

9. The ballistic resistant panel assembly of claim 1, wherein a thread member of the plurality of stitches comprises a composition of nylon, aramid or polyethylene.

10. The ballistic resistant panel assembly of claim 1, wherein the second portion of the binding layer extends about a perimeter of the ballistic resistant panel assembly overlying the peripheral edges of the less than all of the ballistic resistant plies in the stack.

11. The ballistic resistant panel assembly of claim 10, wherein the plurality of stitches form a configuration of rows of stitches which extend along and spaced apart from a peripheral stack edge of the plurality of ballistic resistant plies of the ballistic resistant panel assembly and spaced apart from one another.

12. The ballistic resistant panel assembly of claim 1, wherein the second portion of the binding layer extends along the peripheral edges of the less than all of the plurality of ballistic resistant plies of the stack with the second portion having a length positioned and extending between two shoulder portions of a front ballistic resistant panel assembly.

13. The ballistic resistant panel assembly of claim 12, wherein the plurality of stitches form a configuration of rows of stitches which extend along and spaced apart from a peripheral stack edge of the ballistic resistant plies of the ballistic resistant panel assembly and spaced apart from one another.

14. The ballistic resistant panel assembly of claim 13, wherein each row of stitches includes a back stitch.

15. The ballistic resistant panel assembly of claim 12, wherein the plurality of stitches form a configuration of stitches of a rectangular box configuration with an "x" configuration positioned within the rectangular box configuration.

16. A method for fabricating a ballistic resistant panel assembly, comprising the steps of:

positioning a plurality of ballistic resistant plies into a stack;

placing a binding layer, wherein:

a first portion of the binding layer extends along and overlies a first ballistic resistant ply, of the plurality of ballistic resistant plies;

a second portion of the binding layer extends from the first portion of the binding layer and extends along peripheral edges of a less than all of the plurality of ballistic resistant plies in the stack;

a third portion of the binding layer extends from the second portion of the binding layer and extends along a second ballistic resistant ply of the stack, such that the second ballistic resistant ply is positioned between the first ballistic resistant ply and the third portion of the binding layer; and placing a plurality of stitches through the first portion and the third portion of the binding layer and through the first ballistic resistant ply and the second ballistic resistant ply of the stack.

17. The method of claim 16, wherein at least one ply of the plurality of ballistic resistant plies comprises a fabric constructed from woven fibers composed of high strength fibers.

18. The method of claim 16, wherein at least one ply of the plurality of ballistic resistant plies comprises a composite unidirectional fiber laminate.

19. The method of claim 16, wherein:

placing the binding layer includes positioning the second portion of the binding layer about a perimeter of the ballistic resistant panel overlying the less than all of the peripheral edges of the ballistic resistant plies in the stack; and placing the plurality of stitches to form a configuration of rows of stitches which extend along and spaced apart from a peripheral stack edge of the ballistic resistant plies of the ballistic resistant panel and spaced apart from one another.

20. The method of claim 16, wherein the second portion of the binding layer extends along the peripheral edges of the less than all of the plurality of ballistic resistant plies in the stack with the second portion having a length positioned and extending between two shoulder portions of a front ballistic resistant panel assembly.

21. The method of claim 20, wherein placing the plurality of stitches forms one of:

a configuration of rows of stitches which extend along and spaced apart from a peripheral stack edge of the plurality of ballistic resistant plies of the ballistic resistant panel and spaced apart from one another with each row of stitches having a back stitch; or a configuration which includes a rectangular box configuration with an "x" configuration positioned within the rectangular box configuration.

22. The method of claim 16, wherein the first ballistic resistant ply is positioned on an exterior side of the stack.

23. A ballistic resistant panel assembly, comprising:

a plurality of ballistic resistant plies positioned in a stack;

a binding layer, wherein:

a first portion of the binding layer extends along and overlying a first ballistic resistant ply of the stack;

a second portion of the binding layer extends from the first portion of the binding layer and extends along peripheral edges of a less than all of the plurality of the ballistic resistant plies in the stack; and a third portion of the binding layer extends from the second portion of the binding layer and extends along a second ballistic resistant ply of the stack, such that the second ballistic resistant ply is positioned between the first ballistic resistant ply and the third portion of the binding layer; and a securement mechanism which binds together the first portion of the binding layer to the first ballistic resistant ply and the third portion of the binding layer to the second ballistic resistant ply.

24. The ballistic resistant panel assembly of claim 23, wherein the securement mechanism comprises an adhesive layer positioned between the first portion of the binding layer and the first ballistic resistant ply and positioned between the third portion of the binding layer and the second ballistic resistant ply.

25. The ballistic resistant panel assembly of claim 24, wherein the adhesive layer is positioned between adjacent ballistic resistant plies positioned between the first ballistic resistant ply and the second ballistic resistant ply.

26. The ballistic resistant panel assembly of claim 23, wherein the securement mechanism comprises a compression heated molded layer positioned between the first portion of the binding layer and the first ballistic resistant ply and positioned between the third portion of the binding layer and the second ballistic resistant ply.

27. The ballistic resistant panel assembly of claim 26, wherein the compression heated molded layer is positioned between adjacent ballistic resistant plies positioned between the first ballistic resistant ply and the second ballistic resistant ply.

28. The ballistic resistant panel assembly of claim 23, wherein the securement mechanism comprises a plurality of rivets which extend through the first portion of the binding layer, the first ballistic resistant ply, the second ballistic resistant ply and the third portion of the binding layer.

29. The ballistic resistant panel assembly of claim 28, wherein the plurality of rivets extend through a plurality of ballistic resistant plies positioned between the first ballistic resistant ply and the second ballistic resistant ply.

30. A method for fabricating a ballistic resistant panel assembly, comprising the steps of:

positioning a plurality of ballistic resistant plies into a stack;

placing a binding layer, wherein:

a first portion of the binding layer extends along and overlies a first ballistic resistant ply, of the plurality of ballistic resistant plies;

a second portion of the binding layer extends from the first portion of the binding layer and extends along peripheral edges of a less than all of the plurality of ballistic resistant plies in the stack; and a third portion of the binding layer extends from the second portion of the binding layer and extends along a second ballistic resistant ply of the stack, such that the second ballistic resistant ply is positioned between the first ballistic resistant ply and the third portion of the binding layer; and placing a securement mechanism which binds together the first portion of the binding layer to the first ballistic resistant ply and which binds the third portion of the binding layer to the second ballistic resistant ply.

31. The method of claim 30, wherein the securement mechanism comprises an adhesive layer positioned between the first portion of the binding layer and the first ballistic resistant ply and positioned between the third portion of the binding layer and the second ballistic resistant ply.

32. The method of claim 31, wherein the adhesive layer is positioned between adjacent ballistic resistant plies positioned between the first ballistic resistant ply and the second ballistic resistant ply.

33. The method of claim 30, wherein the securement mechanism comprises a compression heated molded layer positioned between the first portion of the binding layer and the first ballistic resistant ply and positioned between the third portion of the binding layer and the second ballistic resistant ply.

34. The method of claim 33, wherein the compression heated molded layer is positioned between adjacent ballistic resistant plies positioned between the first ballistic resistant ply and the second ballistic resistant ply.

35. The method of claim 30, wherein the securement mechanism comprises a plurality of rivets which extend through the first portion of the binding layer, the first ballistic resistant ply, the second ballistic resistant ply and the third portion of the binding layer.

36. The method of claim 35, wherein the plurality of rivets extend through a plurality of ballistic resistant plies positioned between the first ballistic resistant ply and the second ballistic resistant ply.

37. A ballistic resistant panel assembly, comprising:

a plurality of ballistic resistant plies positioned in a stack; and a binding layer, wherein:

a first portion of the binding layer extends along and overlying a first ballistic resistant ply of the stack;

a second portion of the binding layer extends from the first portion of the binding layer and extends along peripheral edges of a less than all of the plurality of the ballistic resistant plies in the stack; and a third portion of the binding layer extends from the second portion of the binding layer and extends along a second ballistic resistant ply of the stack, such that the second ballistic resistant ply is positioned between the first ballistic resistant ply and the third portion of the binding layer.

38. The ballistic resistant panel assembly of claim 37, wherein a plurality of stitches extends through the first portion and through the third portion of the binding layer and through the first ballistic resistant ply and the second ballistic ply of the stack.

39. The ballistic resistant panel assembly of claim 38, wherein the plurality of stitches forms a configuration of rows of stitches which extend along and spaced apart from a peripheral stack edge of the plurality of ballistic resistant plies of the ballistic resistant panel assembly and spaced apart from one another.

40. A method for fabricating a ballistic resistant panel assembly, comprising the steps of:

positioning a plurality of ballistic resistant plies into a stack; and placing a binding layer, wherein:

a first portion of the binding layer extends along and overlies a first ballistic resistant ply, of the plurality of ballistic resistant plies;

a second portion of the binding layer extends from the first portion of the binding layer and extends along peripheral edges of a less than all of the plurality of ballistic resistant plies in the stack;

a third portion of the binding layer extends from the second portion of the binding layer and extends along a second ballistic resistant ply of the stack, such that the second ballistic resistant ply is positioned between the first ballistic resistant ply and the third portion of the binding layer.

41. The method of claim 40 further includes placing a plurality of stitches through the first portion and the third portion of the binding layer and through the first ballistic resistant ply and the second ballistic resistant ply of the stack.

42. The method of claim 41 wherein placing the plurality of stitches further includes placing the plurality of stitches to form a configuration of rows of stitches which extend along and spaced apart from a peripheral stack edge of the ballistic resistant plies of the ballistic resistant panel and spaced apart from one another.

* * * * *